US011371207B2

(12) United States Patent
Yamaguchi et al.

(10) Patent No.: US 11,371,207 B2
(45) Date of Patent: Jun. 28, 2022

(54) WORK EQUIPMENT FOR MOTOR GRADER

(71) Applicant: Komatsu Ltd., Tokyo (JP)

(72) Inventors: Kota Yamaguchi, Tokyo (JP); Yuji Asai, Tokyo (JP); Toshihiro Yone, Tokyo (JP)

(73) Assignee: Komatsu Ltd., Tokyo (JP)

( * ) Notice: Subject to any disclaimer, the term of this patent is extended or adjusted under 35 U.S.C. 154(b) by 411 days.

(21) Appl. No.: 16/480,836

(22) PCT Filed: Apr. 25, 2018

(86) PCT No.: PCT/JP2018/016802
§ 371 (c)(1),
(2) Date: Jul. 25, 2019

(87) PCT Pub. No.: WO2019/207681
PCT Pub. Date: Oct. 31, 2019

(65) Prior Publication Data

US 2021/0348361 A1 Nov. 11, 2021

(51) Int. Cl.
*E02F 3/76* (2006.01)
*E02F 3/80* (2006.01)

(52) U.S. Cl.
CPC ..... *E02F 3/764* (2013.01); *E02F 3/80* (2013.01)

(58) Field of Classification Search
CPC . E02F 3/764; E02F 3/80; E02F 3/7627; E02F 3/7663; E02F 3/7668; E02F 3/7686; F16C 33/6659
See application file for complete search history.

(56) References Cited

U.S. PATENT DOCUMENTS 4,015,669 A * 4/1977 Cole ..... E02F 3/764 172/796
4,122,903 A * 10/1978 Cole ..... E02F 3/764 172/747
4,185,700 A * 1/1980 Atherton ..... E02F 3/764 172/796
4,961,667 A 10/1990 Reinsma et al.
2013/0206889 A1 8/2013 Ochiai
(Continued)

FOREIGN PATENT DOCUMENTS

CN 104846866 A 8/2015
CN 204823952 U 12/2015
(Continued)

*Primary Examiner* — Jamie L McGowan
(74) *Attorney, Agent, or Firm* — Locke Lord LLP

(57) ABSTRACT

A work equipment includes: a drawbar having a drawbar plate; a bearing having an outer ring which is fixed to a lower surface of the drawbar plate, and an inner ring which is disposed inside the outer ring and is connected to the outer ring so as to be rotatable in a peripheral direction with respect to the outer ring; and a circle having a circle plate that is fixed to a lower end of the inner ring over the peripheral direction, an outer peripheral-side wall portion that is connected to an outer peripheral side of the circle plate and has a cylindrical shape surrounding the bearing from an outer peripheral side, and an inner circumferential-side wall portion protruding from the upper surface of the circle plate between the bearing and the outer peripheral-side wall portion, extends in the peripheral direction, and faces the outer ring in the radial direction.

6 Claims, 4 Drawing Sheets

(56) References Cited

U.S. PATENT DOCUMENTS

| | | | | |
|---|---|---|---|---|
| 2015/0135866 | A1* | 5/2015 | Staade | F16H 57/029 74/89.18 |
| 2015/0233091 | A1 | 8/2015 | Furusho et al. | |
| 2021/0140514 | A1* | 5/2021 | Smemo | E02F 3/7645 |
| 2021/0180289 | A1* | 6/2021 | Gundupalli | E02F 3/8157 |
| 2021/0285453 | A1* | 9/2021 | Sishtla | F16C 32/0442 |

FOREIGN PATENT DOCUMENTS

| | | | |
|---|---|---|---|
| CN | 107842703 | A | 3/2018 |
| CN | 207260213 | U | 4/2018 |
| JP | 04-502805 | A | 5/1992 |
| JP | H05-081354 | U | 11/1993 |
| JP | 2012-080661 | A | 4/2012 |
| JP | 2013-179882 | A | 9/2013 |

* cited by examiner

WORK EQUIPMENT FOR MOTOR GRADER

TECHNICAL FIELD

The present invention relates to a work equipment for a motor grader.

BACKGROUND TECHNOLOGY

Patent Document 1 discloses a work equipment for a motor grader. The work equipment has a circle that supports a blade. The circle is rotatably supported to a drawbar via a bearing provided in a space between the circle and the drawbar. In a clearance between the drawbar and the circle rotating relative to each other, a seal for preventing from dirt entering into the space is provided.

PRIOR ART DOCUMENT

Patent Document

[Patent Document 1] US Patent Application No. 2015-0135866, specification.

SUMMARY OF THE INVENTION

Problems to be Solved by the Invention

Since the seal comes into sliding contact with one of the drawbar and the circle, the seal is gradually worn. If the wear of the seal progresses, as a result of dirt flowing into the space from the clearance, the wear of a sliding portion of the bearing also progresses. Therefore, the maintenance frequency of the seal and the bearing is increased.

The present invention is taken into consideration in view of the above problem, and the object of the present invention is to provide a work equipment for a motor grader securing durability and being capable of improving maintenance performance.

Means for Solving the Problem

An aspect of the present invention provides a work equipment for a motor grader comprising: a drawbar having a drawbar plate extending along a horizontal surface; a bearing having an outer ring which has an annular shape when seen from a plan view and is fixed to a lower surface of the draw bar plate, and an inner ring which has an annular shape when seen from a plan view and is disposed inside the outer ring and which is connected to the outer ring so as to be rotatable in a peripheral direction with respect to the outer ring; a lubricant supply unit configured to supply a lubricant between the outer ring and the inner ring in the bearing; a circle having a circle plate that is fixed to a lower end of the inner ring over the peripheral direction and protrudes outward in a radial direction of the outer ring, an outer peripheral-side wall portion that is connected to an outer peripheral side of the circle plate and has a cylindrical shape surrounding the bearing from an outer peripheral side and that forms a clearance between the outer peripheral-side wall portion and the lower surface of the drawbar plate, and an inner circumferential-side wall portion that protrudes from the upper surface of the circle plate between the bearing and the outer peripheral-side wall portion, extends in the peripheral direction, and faces the outer ring from an outside in the radial direction; and a blade supported by the circle.

According to the above structure, when dirt flows into the space between the drawbar and the circle through the clearance, the dirt is introduced between the outer peripheral side wall portion and the inner peripheral side wall portion. At this time, since the progress of the dirt is prevented by the inner peripheral side wall portion, it is possible to prevent the dirt passing through the clearance from directly reaching the bearing.

In addition, a lubricant which leaks downward from between the outer ring and the inner ring is accumulated in a space inside the inner peripheral side wall portion. By the lubricant accumulated in such a manner, the progress of dirt can be suppressed.

Therefore, even when the dirt passes over the inner peripheral side wall portion, it is possible to suppress the dirt from reaching the bearing. As a result, it is possible to prevent the dirt from reaching the bearing without providing a seal to the clearance.

Effect of Invention

According to the work equipment for the motor grader of present invention, durability of work equipment can be secured, and maintenance performance can be improved.

BRIEF DESCRIPTION OF DRAWINGS

In FIG. 2, a blade is omitted from the drawing.

MODE FOR CARRYING OUT THE INVENTION

An embodiment of the present invention will be described in detail below with reference to FIGS. 1 to 5.

<<Motor Grader>>

Figure 1:
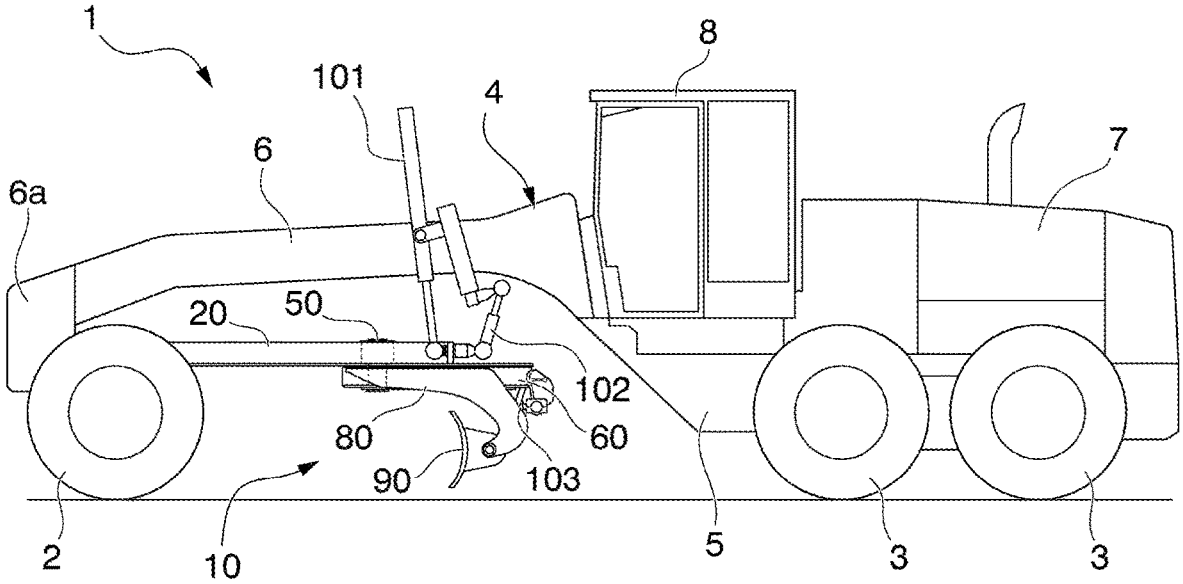
FIG. 1 is a side view of a motor grader according to an embodiment of the present invention.

As shown in FIG. 1, a motor grader 1 of the embodiment is mainly provided with a traveling wheels 2,3, a vehicle body frame 4, a cab 8, and a work equipment 10. The work equipment 10 has a blade 90. The motor grader 1 performs works such as a ground leveling work, a snow removal work, a light cutting work, material mixing work, or the like, by the blade 90.

The motor grader 1 has front wheels 2 and rear wheels 3 as traveling wheels 2, 3. The motor grader 1 of the present embodiment has two front wheels 2, each one of which is provided on both side, and four rear wheels 3, each two of which are provided on both side.

In the following description, forward-rearward directions refers to forward-rearward directions of the motor grader 1. That is, the "forward-rearward directions" means the forward-rearward directions as viewed from the driver seated on the driver's seat of the cab 8. A "vehicle width direction" means a vehicle width direction of the motor grader 1. That is, the vehicle width direction means left and right directions as viewed from the driver seated on the driver's seat of the cab 8.

The vehicle body frame 4 includes a rear frame 5, a front frame 6, and an exterior cover 7. The rear frame 5 supports components (not shown) such as an exterior cover 7 and an engine disposed in an engine chamber. The exterior cover 7 covers the engine chamber at a rear of the cab 8. In the rear frame 5, each of the four rear wheels 3 is mounted so as to be capable of being rotationally driven by driving force from the engine. The front frame 6 is attached to a front of the rear frame 5. A counterweight 6*a* is attached to a front end of the front frame 6. At a lower portion of the front end of the front frame, the two front wheels 2 are rotatably attached.

The cab 8 is placed on a front portion of the rear frame 5. In an inside portion of the cab 8, an operating unit (not shown) such as a steering wheel, a shift lever, an operation lever for the work equipment 10, a brake, an accelerator pedal, an inching reel, and the like, are provided.

<<Work Equipment>>

Figure 2:
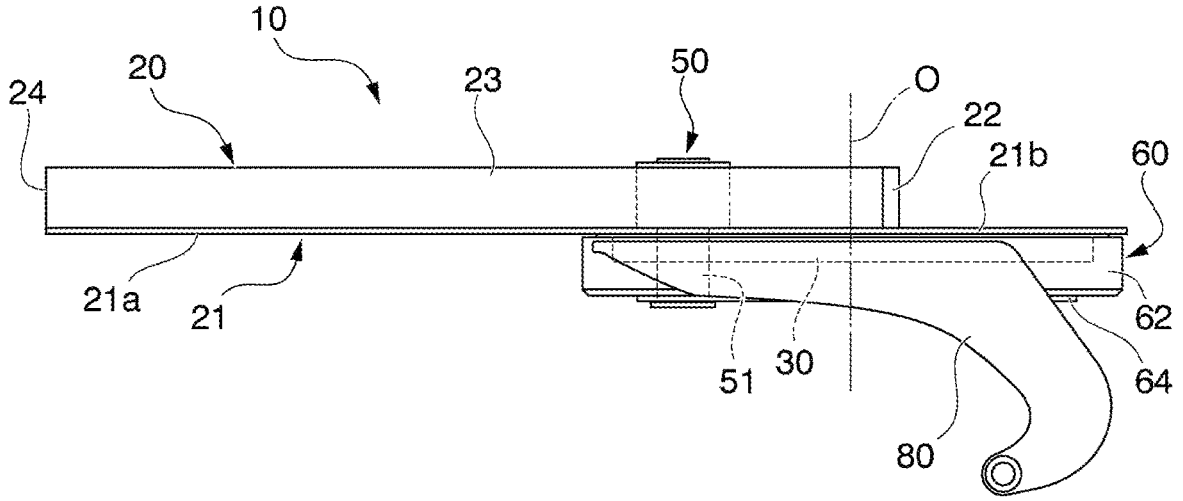
FIG. 2 is a side view of a work equipment for the motor grader according to the embodiment of the present invention.
Figure 3:
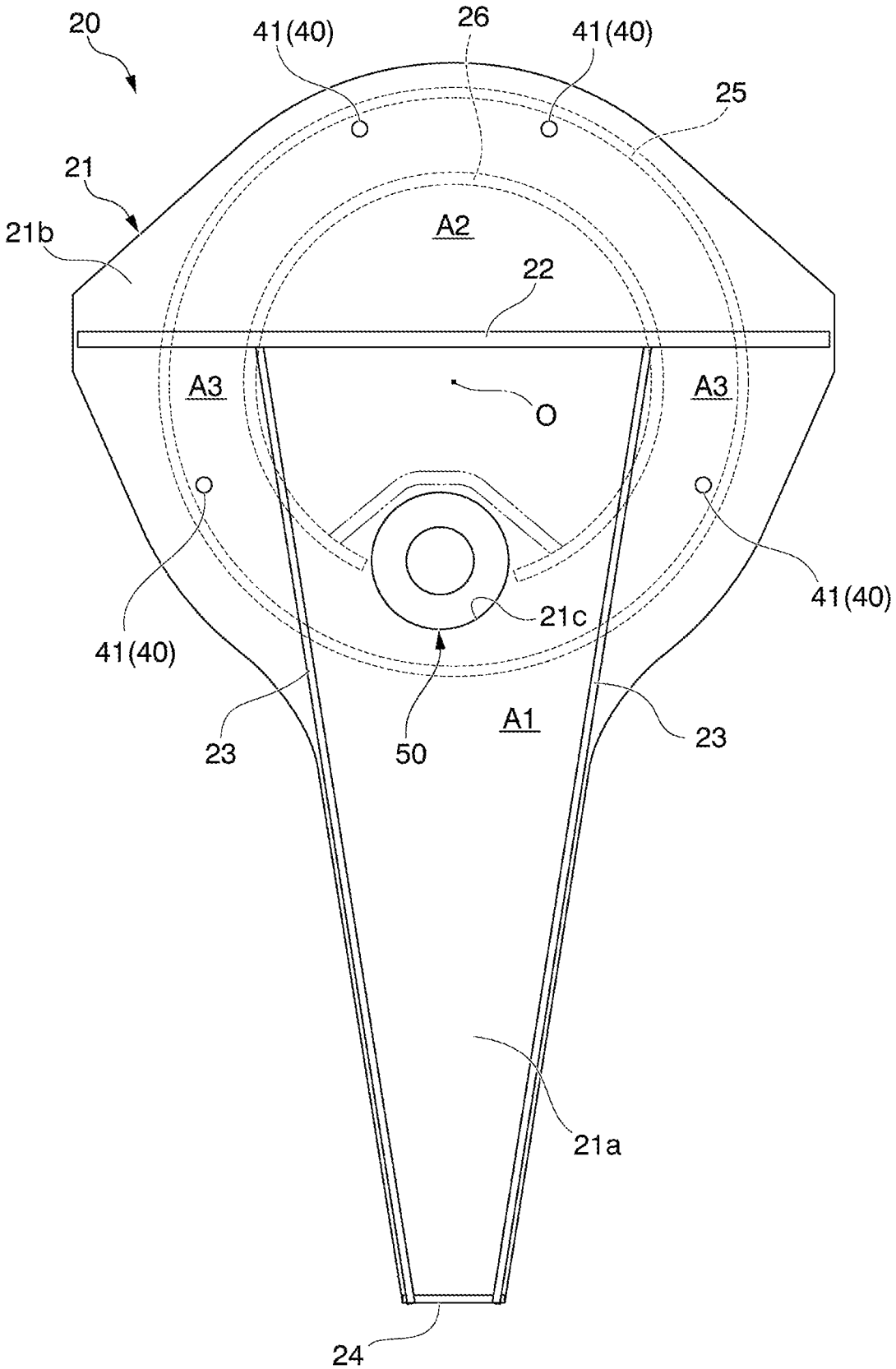
FIG. 3 is a plan view of a drawbar of the work equipment for the motor grader according to the embodiment of the present invention.
Figure 4:
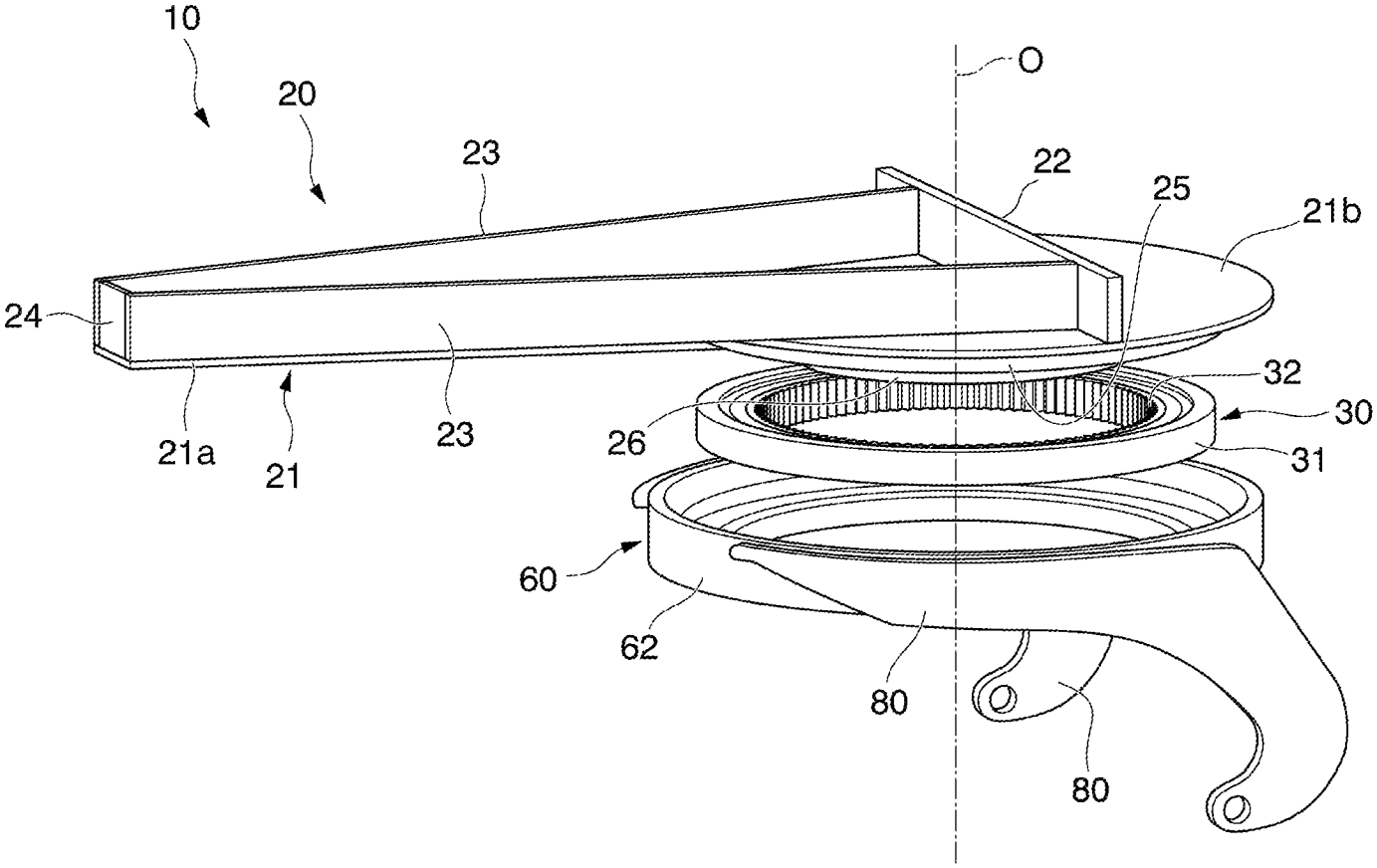
FIG. 4 is an exploded perspective view of the drawbar, a bearing, a circle and a support of the work equipment for the motor grader according to the embodiment of the present invention.
Figure 5:
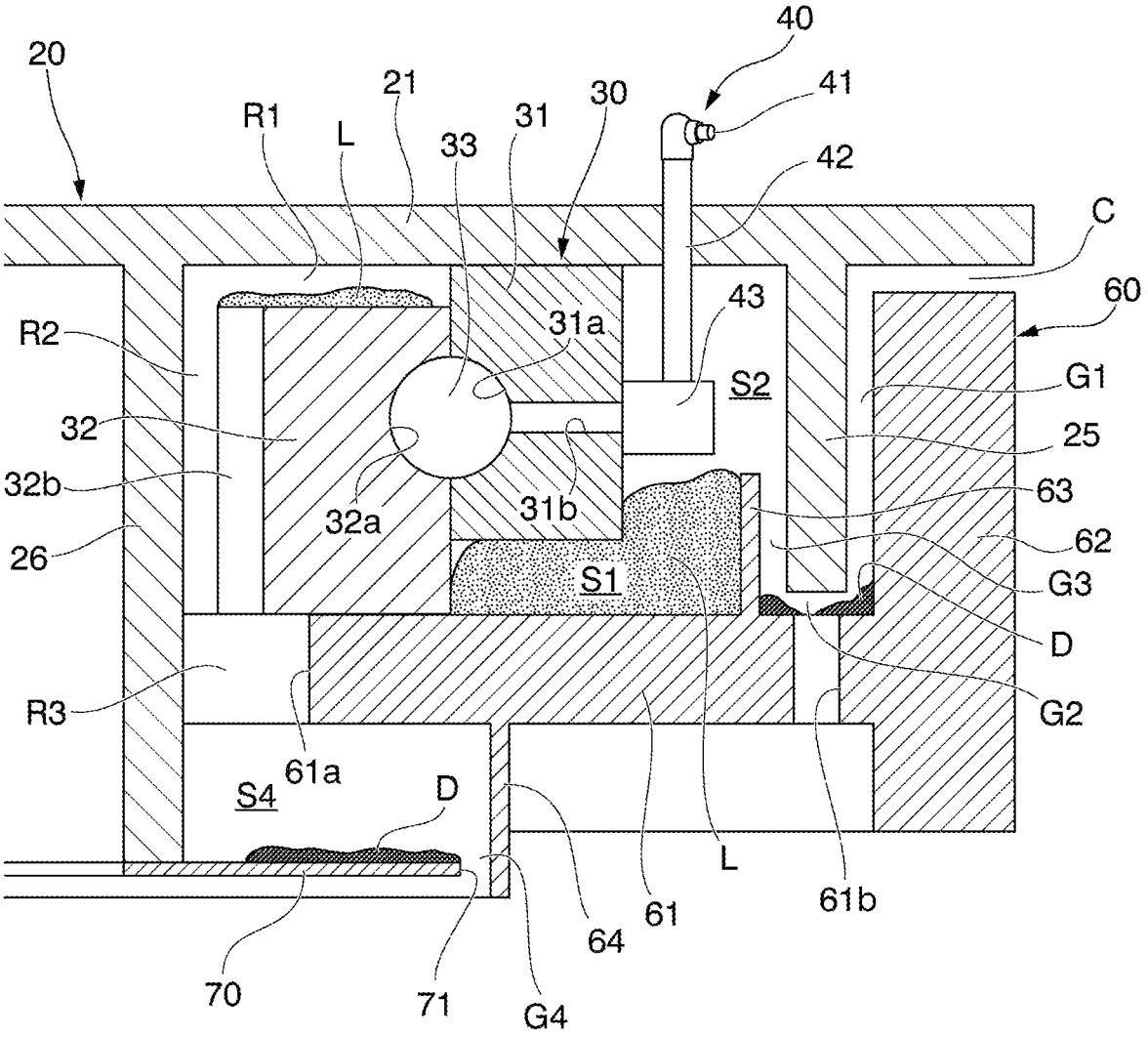
FIG. 5 is a partial longitudinal sectional view of the drawbar, bearing and circle of the work equipment for the motor grader according to the embodiment of the present invention.

As shown in FIGS. 2 to 4, the work equipment 10 includes a drawbar 20, a bearing 30, a slew motor 50, a circle 60 and a support 80 in addition to the blade 90. Further, as shown in FIG. 5, the work equipment 10 is provided with a lubricant supply unit 40 and a bottom cover 70.

<<Drawbar>>

As shown in FIGS. 2 to 4, the drawbar 20 includes a drawbar plate 21, a lateral rib 22, a vertical rib 23, an outer peripheral-side rib 25, and an inner peripheral-side rib 26.

<<Drawbar Plate>>

The drawbar plate 21 has a plate shape extending along a horizontal surface. An upper surface and a lower surface of the drawbar plate 21 has a planar shape extending along the horizontal surface. The drawbar plate 21 extends in the forward-rearward directions as a longitudinal direction. A portion on the forward side of the drawbar plate 21 is a plate front portion 21*a* which tapers in a forward side when seen from a plan view. A portion of the drawbar plate 21 on the rearward side is a plate rear portion 21*b* which is made larger in the vehicle width direction than the plate front portion 21*a*. The plate rear portion 21*b* has a shape in which, after a size in the vehicle width direction becomes gradually larger toward the rearward side from the rear end of the plate front portion 21*a*, a distance in the vehicle width direction becomes smaller toward the rear.

<<Lateral Rib>>

The lateral rib 22 has a plate shape protruding from an upper surface of the plate rear portion 21*b* in the drawbar plate 21 and extending in the vehicle width direction. The lateral rib 22 is provided at a position of the forward-rearward directions at which the vehicle width direction in the plate rear portion 21*b* is maximized.

<<Vertical Rib>>

The vertical rib 23 protrudes from the drawbar plate 21 and has a plate shape extending in the forward-rearward directions over the plate front portion 21*a* and the plate rear portion 21*b* of the drawbar plate 21. A pair of the vertical ribs 23 is provided at a distance from each other in the vehicle width direction. A rear end of each vertical rib 23 is connected to a front surface of the lateral rib 22. A position in the forward-rearward directions of the distal end of each vertical rib 23 coincides with the distal end of the plate front portion 21*a*. The pair of vertical ribs 23 is provided so that a distance in the vehicle width direction of the pair of vertical ribs 23 becomes smaller toward the forward side. A portion on the plate front portion 21*a* in the pair of vertical ribs 23 extends so as to coincide with a side edge portion of the plate front portion 21*a* in the vehicle width direction when seen from a plan view.

In a region on the drawbar plate 21, a front portion and a central portion sectioned by the pair of vertical ribs 23 and the lateral rib 22 are defined as a front portion region A1. The front portion region A1 has a motor through hole 21*c* which penetrates the drawbar plate 21 in the vertical direction. The motor through hole 21*c* is formed at a position near the center of the vehicle width direction.

In the region on the drawbar plate 21, a portion on the rearward side of the lateral rib 22 is defined as a rear portion area A2. In the region on the drawbar plate 21, a portion between a surface facing the outer side in the vehicle width direction of each vertical rib 23 and a front surface of the lateral rib 22 is defined as a side portion region A3. A pair of side portion regions A3 is formed at a distance from each other in the vehicle width direction.

A connecting portion 24 is provided between the front end of the pair of vertical ribs 23 and the front end of the drawbar plate 21. A sliding member (not shown) is connected to the connecting portion 24. The sliding member is connected to the front frame 6. The drawbar 20 is connected to each hydraulic cylinder, as will be described later. The drawbar 20 is swingable with respect to the front frame 6 in accordance with the expansion and contraction of each hydraulic cylinder.

<<Outer Peripheral-Side Rib>>

As shown in FIGS. 3 to 5, the outer peripheral-side rib 25 is provided so as to protrude downward from a lower surface of the plate rear portion 21*b* in the drawbar plate 21. The outer peripheral-side rib 25 has a plate shape extending in a peripheral direction of an imaginary circle (hereinafter referred to simply as a peripheral direction) centered on an axis O extending in the vertical direction. The axis O is located in a center portion of the plate rear portion 21*b*. The outer peripheral-side rib 25 has a plate shape in which a radial direction of the imaginary circle (hereinafter simply referred to as a radial direction) is in the thickness direction. The protruding length of the outer peripheral-side rib 25, that is, a size in the vertical direction is constant in the entire peripheral direction.

The outer peripheral-side rib 25 of the present embodiment has an annular shape centered on the axis O when seen from a plan view. The outer peripheral-side rib 25 extends so as to pass through the front portion region A1, the rear portion region A2, and the side portion region A3 in the upper surface of the drawbar 20 when seen from a plan view. That is, the outer peripheral-side rib 25 overlaps with the lateral rib 22 and the pair of vertical ribs 23 when seen from a plan view and extends across the lateral rib 22 and the pair of vertical ribs 23.

<<Inner Peripheral-Side Rib>>

As shown in FIGS. 3 to 5, the inner peripheral-side rib 26 is provided inside in the radial direction of the outer peripheral-side rib 25 in the lower surface of the drawbar plate 21. The inner peripheral-side rib 26 is provided so as to protrude downward from the lower surface of the plate rear portion 21*b* in the drawbar plate 21, similarly to the outer peripheral-side rib 25. The inner peripheral-side rib 26 has a plate-like shape extending in the peripheral direction. The inner peripheral-side rib 26 has a plate shape in which the radial direction is the thickness direction. The most part of the inner peripheral-side rib 26 except for a forward part of the inner peripheral-side rib 26 of the present embodiment extends in an annular shape centered on the axis O when seen from a plan view.

As shown in FIG. 3, the forward part of the inner peripheral-side rib 26 extends so as to be recessed toward the rearward side so as to avoid the motor through hole 21*c* when seen from a plan view. The protruding length of the inner peripheral-side rib 26, that is, a size in the vertical direction of the inner peripheral-side rib 26 is constant over the peripheral direction. As shown in FIG. 5, the protruding length of the inner peripheral-side rib 26 is set to be longer than the protruding length of the outer peripheral-side rib 25. That is, a lower end of the inner peripheral-side rib 26 is located lower than a lower end of the outer peripheral-side rib 25.

As shown in FIG. 3, the inner peripheral-side rib 26 is extended so as to pass through front portion region A1, the rear portion region A2 and the side portion region A3 in the upper surface of the drawbar 20 in the same manner as the outer peripheral-side rib 25. That is, the outer peripheral-side rib 25 overlaps with the lateral rib 22 and the pair of vertical ribs 23 when seen from a plan view and extends across the lateral rib 22 and the pair of vertical ribs 23.

As shown in FIG. 1, the drawbar 20 is connected to the front frame 6 by a hydraulic cylinder such as a pair of left and right lift cylinders 101 and drawbar shift cylinders 102. By the pair of lift cylinders 101, the drawbar 20 is capable of being lifted and lowered and being swung around an axis along the forward-rearward directions. The drawbar shift cylinder 102 allows the drawbar 20 to be moved in left and right directions relative to the front frame 6.

<<Bearing>>

As shown in FIGS. 4 and 5, the bearing 30 is a member having an annular shape centered on the axis O and is provided in a space between the drawbar 20 and the circle 60 below the drawbar 20. As shown in FIG. 5, the bearing 30 is provided so as to be sandwiched between the outer peripheral-side rib 25 and the inner peripheral-side rib 26 below the drawbar 20 and is interposed between the outer peripheral-side rib 25 and the inner peripheral-side rib 26. The bearing 30 includes an outer ring 31, an inner ring 32, and a rolling body 33.

<<Outer Ring>>

The outer ring 31 is a member having an annular shape centered on the axis O when seen from a plan view. As shown in FIG. 5, the outer ring 31 has a rectangular cross section which is orthogonal to the peripheral direction. An upper-end surface of the outer ring 31 has a flat shape along a horizontal surface. The upper-end surface of the outer ring 31 is fixed to the lower surface of the plate rear portion 21*b* in the drawbar 20 over the peripheral direction. The outer ring 31 is fixedly integrated with the drawbar plate 21 by a plurality of bolts (not shown) passing through the drawbar plate 21 vertically and arranged in the peripheral direction. The outer ring 31 is provided between the outer peripheral-side rib 25 and the inner peripheral-side rib 26 on the lower surface of the drawbar plate 21. The lower end surface of the outer ring 31 has a flat shape along a horizontal surface. The lower end surface of the outer ring 31 is located above the lower end of an outer peripheral-side wall portion 62.

An inner peripheral surface and an outer peripheral surface of the outer ring 31 have a cylindrical shape which is parallel to the axis O. In the inner peripheral surface of the outer ring 31, an outer ring recessed groove 31*a* recessed from the inner peripheral surface and extending over the peripheral direction is formed. In the outer ring 31, a plurality of supply holes 31*b* penetrating the inner peripheral surface and the outer peripheral surface of the outer ring 31 in the radial direction are formed at a distance from each other in the peripheral direction.

The outer peripheral surface of the outer ring 31 faces the inner peripheral surface of the outer peripheral-side rib 25 of the drawbar 20 at a distance inside in the radial direction from the inner peripheral surface of the outer peripheral-side rib 25. Thus, the outer peripheral-side space S2 is formed between the outer peripheral surface of the outer ring 31 and the inner peripheral surface of the outer peripheral-side rib 25 of the drawbar 20.

<<Inner Ring>>

As shown in FIG. 4, the inner ring 32 is a member having an annular shape centered on the axis O when seen from a plan view. The inner ring 32 has a diameter smaller than that of the outer ring 31 and is disposed inside of the outer ring 31 in the radial direction. As shown in FIG. 5, the inner ring 32 has a rectangular cross section which is orthogonal to the peripheral direction. An upper-end surface of the inner ring 32 is located one step lower than the upper-end surface of the outer ring 31. Thus, the portion space R1 is formed between the upper-end surface of the inner ring 32 and the lower surface of the drawbar plate 21. The lower-end surface of the inner ring 32 is located one step lower than the lower-end surface of the outer ring 31.

The outer peripheral surface of the inner ring 32 has a cylindrical shape centered on the axis O. The outer peripheral surface of the inner ring 32 is disposed with a slight clearance with respect to the inner peripheral surface of the outer ring 31. An inner ring recessed groove 32*a* recessed inside in the radial direction from the outer peripheral surface and extending over the peripheral direction is formed on the outer peripheral surface of the inner ring 32. A position in the vertical direction of the inner ring recessed groove 32*a* corresponds to the position in the vertical direction of the outer ring recessed groove 31*a*.

On a portion in the inner peripheral side of the inner ring 32, inner gear teeth 32*b* in which irregularities are continuous in the peripheral direction so as to form an annular shape centered on the axis O are formed over the peripheral direction and the vertical direction. The inner gear teeth 32*b* of the inner ring 32 are arranged at a distance in the radial direction from the outer peripheral surface of the inner peripheral-side rib 26 of the drawbar 20. A space between the inner gear teeth 32*b* of the inner ring 32 and the inner peripheral-side rib 26 of the drawbar 20 is defined as an inner peripheral-side space R2 extending in the vertical direction and the peripheral direction. An upper end of the inner peripheral-side space R2 is connected to the upper portion space R1.

<<Rolling Body>>

The rolling body 33 is provided between the outer ring 31 and the inner ring 32, and is a member that makes the outer ring 31 and the inner ring 32 be capable of rotating relatively to each other in the peripheral direction by sliding contact with the outer ring 31 and the inner ring 32. The rolling body 33 of the present embodiment is a ball having a spherical shape. A plurality of rolling bodies 33 are accommodated in the accommodating space sectioned by the outer ring recessed groove 31*a* and the inner ring recessed groove 32*a* over the peripheral direction. As the rolling body 33, a rod-shaped roller may be used. In this case, a plurality of rollers are arranged over the peripheral direction with a center axis of each roller directing the vertical direction.

<<Lubricant Supply Unit>>

As shown in FIG. 5, the lubricant supply unit 40 is a member for supplying a lubricant between the outer ring 31 and the inner ring 32 in the bearing 30. The lubricant supply unit 40 includes an inlet port 41, a penetration pipe 42, and a connection portion 43.

The inlet port 41 is a so-called grease nipple. In the present embodiment, grease L is employed as a lubricant, and the grease L is pumped to the inlet port 41 from the outside, whereby the grease L is supplied to the bearing 30.

A plurality of inlet ports 41 are provided on the upper surface of the drawbar plate 21. As shown in FIG. 3, a plurality of (four in the present embodiment) inlet ports 41 are provided at a distance from each other in the peripheral direction. The inlet port 41 is provided in the side portion region A3 and the rear portion region A2 in the upper surface of the drawbar plate 21. In the present embodiment, one inlet port 41 is provided in each side portion region A3, and two inlet ports 41 are provided in the rear portion regions A2 at a distance from each other in the vehicle width direction. As shown in FIG. 5, each inlet port 41 is disposed outside in the radial direction and upward from the outer ring 31.

The penetration pipe 42 is a pipe extending in the vertical direction so as to penetrate the drawbar plate 21 vertically. The upper end of the penetration pipe 42 is connected to the inlet port 41. The lower portion of the penetration pipe 42 is located in the outer peripheral-side space S2.

The connection portion 43 is provided in the outer peripheral-side space S2 and is attached to opening portions of the respective supply holes 31*b* in the outer peripheral surface of the outer ring 31. The connection portion 43 is connected to the lower end of the penetration pipe 42. The connection portion 43 connects the penetration pipe 42 and the supply hole 31*b* to communicate each other. Thus, the lubricant introduced from the inlet port 41 is supplied to the supply hole 31*b* through the penetration pipe 42 and the connection portion 43.

<<Slew Motor>>

As shown in FIGS. 2 and 3, the slew motor 50 is provided so as to pass through the motor through hole 21*c* of the drawbar plate 21 vertically. The slew motor 50 is integrally fixed to the drawbar plate 21 via a bolt (not shown). As shown in FIG. 2, a pinion 51 is provided on a lower portion of the slew motor 50. The pinion 51 is capable of being rotatably driven about an axis extending in the vertical direction below the drawbar plate 21. Gear teeth are formed on an outer peripheral surface of the pinion 51, and are engaged with the inner gear teeth 32*b* of the inner ring 32.

<<Circle>>

As shown in FIGS. 2, 3 and 5, the circle 60 is provided so as to be rotatable about the axis O through the bearing 30 below the drawbar 20. The circle 60 includes a circle plate 61, an outer peripheral-side wall portion 62, an inner peripheral-side wall portion 63, and a lower-side wall portion 64.

<<Circle Plate>>

The circle plate 61 has an annular shape centered on the axis O when seen from a plan view and has a plate shape extending in the horizontal direction. An upper surface and a lower surface of the circle plate 61 has a planar shape along the horizontal surface. As shown in FIG. 5, the circle plate 61 is fixed to the lower end surface of the inner ring 32 by a fixing member (not shown) such as bolts over the peripheral direction. As a result, the circle plate 61 rotates about the axis O integrally with the inner ring 32. That is, the circle plate 61 is relatively rotatable about the axis O with respect to the drawbar plate 21 via the bearing 30. The lower surface of the circle plate 61 is located above the lower end of the inner peripheral-side rib 26 of the drawbar 20.

An inner peripheral edge portion 61*a* of the circle plate 61 has a circular shape centered on the axis O. The inner peripheral edge portion 61*a* of the circle plate 61 faces the outer peripheral surface of the inner peripheral-side rib 26 of the drawbar 20 from an outside in the radial direction. Thus, a communication space R3 is formed between the inner peripheral edge portion 61*a* of the circle plate 61 and the outer peripheral surface of the inner peripheral-side rib 26 of the drawbar 20 to communicate the inner peripheral-side space R2 downward over the peripheral direction.

A position in the radial direction of the inner peripheral edge portion 61*a* of the circle plate 61 is located between the inner gear teeth 32*b* of the inner ring 32 and the outer peripheral surface of the inner ring 32. The circle plate 61 is arranged so as to protrude outward in the radial direction from the inner peripheral edge portion 61*a*. The circle plate 61 extends outward in the radial direction rather than the outer peripheral-side rib 25 of the drawbar 20.

The upper surface of the circle plate 61 and the lower end of the outer peripheral-side rib 25 of the drawbar 20 face at a distance from each other in the vertical direction. A lower-side gap G2 extending in the radial direction and the peripheral direction is formed between the upper surface of the circle plate 61 and the lower end of the outer peripheral-side rib 25 of the drawbar 20.

The upper surface of the circle plate 61 and the lower end surface of the outer ring 31 face at a distance from each other in the vertical direction. A distance between the upper surface of the circle plate 61 and the lower end surface of the outer ring 31 is larger than a distance of the lower-side gap G2 in the vertical direction.

<<Outer Peripheral-Side Wall Portion>>

The outer peripheral-side wall portion 62 has a cylindrical shape centered on the axis O. The inner peripheral surface of the outer peripheral-side wall portion 62 is connected to the outer peripheral side of the circle plate 61. The outer peripheral-side wall portion 62 extends from the outer periphery of the circle plate 61 both upward and downward. The outer peripheral-side wall portion 62 surrounds the bearing 30 from the outer peripheral side thereof. The upper end of the outer peripheral-side wall portion 62 faces the lower surface of the drawbar plate 21 at a distance from the lower surface of the drawbar plate 21 in the vertical direction. That is, a clearance C which penetrates in the radial direction over the peripheral direction is formed between the upper end of the outer peripheral-side wall portion 62 and the lower surface of the drawbar plate 21.

The inner peripheral surface of the outer peripheral-side wall portion 62 faces the outer peripheral surface of the outer peripheral-side rib 25 of the drawbar 20 at a distance from the outer peripheral surface of the outer peripheral-side rib 25 in the radial direction. As a result, an outer peripheral-side gap G1, an upper end of which is communicated with the clearance C, and which extends over the vertical direction and the peripheral direction, is formed between the outer peripheral-side wall portion 62 and the outer peripheral-side rib portion 25. The lower end of the outer peripheral-side gap G1 is connected to the end portion outside in the radial direction of the lower-side gap G2.

<<Inner Peripheral-Side Wall Portion>>

As shown in FIG. 5, the inner peripheral-side wall portion 63 protrudes from the upper surface of the circular plate 61 at a position in the radial direction between the outer ring 31 of the bearing 30 and the outer peripheral-side rib 25, and extends in the peripheral direction. The inner peripheral-side wall portion 63 has a circular shape centered on the axis O when seen from a plan view.

The upper end of the inner peripheral-side wall portion 63 faces the lower surface of the drawbar plate 21 at a distance from the lower surface of the drawbar plate 21 in the vertical direction. The upper end of the inner peripheral-side wall portion 63 is located below the lower end of the connection portion 43 in the lubricant supply unit 40. The upper end of the inner peripheral-side wall portion 63 is located above the lower end surface of the outer ring 31. Accordingly, the inner peripheral surface of the inner peripheral-side wall portion 63 faces the outer peripheral surface of the outer ring 31 in the radial direction.

The upper end of the inner peripheral-side wall portion 63 is located above the lower end of the outer peripheral-side rib 25 of the drawbar 20. The outer peripheral surface of the inner peripheral-side wall portion 63 faces the inner peripheral surface of the outer peripheral-side rib 25 of the drawbar 20 at a distance from the inner peripheral surface of the outer peripheral-side rib 25 in the radial direction. As a result, an inner peripheral-side gap G3 extending over the vertical direction and the peripheral direction is formed between the inner peripheral-side wall portion 63 and the outer peripheral-side rib 25. The lower end of the inner peripheral-side gap G3 is connected to the end portion inside in the radial direction of the lower-side gap G2. As a result, the inner peripheral-side gap G3 communicates with the outer peripheral-side gap G1 through the lower-side gap G2. The upper end of the inner peripheral-side gap G3 communicates with the outer peripheral-side space S2.

<<Discharge Hole>>

As shown in FIG. 5, a discharge hole 61*b* vertically penetrating the circle plate 61 is formed in a portion between the outer peripheral-side wall portion 62 and the inner peripheral-side wall portion 63 of the circle plate 61. A plurality of discharge holes 61*b* are formed in a peripheral direction at a distance from each other. Each discharge hole 61*b* communicates the lower-side gap G2 to the lower side of the circle plate 61. A lower end of the outer peripheral-side rib 25 of the drawbar 20 is located above an opening portion of the discharge hole 61*b* in the upper surface of the circle plate 61. That is, the discharge hole 61*b* is formed at a position facing the lower end of the outer peripheral-side rib 25 from below. An inner diameter of the discharge hole 61*b* is larger than a size in the vertical direction of the lower-side gap G2.

<<Lower-Side Wall Portion>>

As shown in FIG. 5, the lower-side wall portion 64 protrudes downward from the lower surface of the circle plate 61 and extends in the peripheral direction. The lower-side wall portion 64 has a circular shape centered on the axis O when seen from a plan view. A position of the lower-side wall portion 64 in the radial direction is located between the inner peripheral edge portion 61*a* and the inner peripheral-side wall portion 61 of the circle plate 63. The position of the lower-side wall portion 64 in the radial direction is located outside from the outer peripheral surface of the inner ring 32 in the radial direction.

<<Bottom Cover>>

The bottom cover 70 shown in FIG. 5 has an annular shape centered on the axis O when seen from a plan view and has a plate shape extending in the horizontal direction. The upper surface and the lower surface of the bottom cover 70 has a planar shape along the horizontal surface. The bottom cover 70 is fixed to the lower end of the inner peripheral-side rib 26 of the drawbar 20 by bolts (not shown) over the peripheral direction. The bottom cover 70 may be fixed to the inner peripheral-side rib 26 via a bracket or the like. The bottom cover 70 may be configured to be segmented into a plurality of parts in a peripheral direction.

The inner periphery of the bottom cover 70 is disposed along the inner peripheral-side rib 26. The bottom cover 70 extends outward in the radial direction from a fixing portion with the inner peripheral-side rib 26. The outer peripheral edge portion 71 of the bottom cover 70 faces the inner peripheral surface of the lower-side wall portion 64 of the circle 60 from an inside in the radial direction. As a result, a bottom gap G4 passing through vertically over the peripheral direction is formed between the outer peripheral edge portion 71 of the bottom cover 70 and the inner peripheral surface of the lower-side wall portion 64. The lower end of the lower-side wall portion 64 is located below the bottom cover 70.

A space sectioned by the outer peripheral surface of the inner peripheral-side rib 26, the lower surface of the circle plate 61, the inner peripheral surface of the lower-side wall portion 64 and the upper surface of the bottom cover 70 is defined as a bottom space R4. The bottom space R4 communicates with the inner peripheral-side space R2 through the communication space R3. The bottom space R4 communicates downwardly through the bottom gap G4.

<<Support>>

As shown in FIG. 2, a pair of supports 80 is fixed to the outer peripheral surface of the outer peripheral-side wall portion 62, which becomes the outer peripheral surface of the circle 60, at a distance from each other in the vehicle width direction. Each support 80 extends rearward along the outer peripheral surface of the circle 60, and then, extends and curves downward.

<<Blade>>

The blade 90 extends horizontally below the circle 60. The blade 90 is supported by the pair of supports 80. That is, the blade 90 is supported by the circle 60 through the supports 80. The blade 90 is relatively movable in an extension direction of the blade 90 with respect to the circle 60 by a blade shift cylinder (not shown). The drawbar 20 is swingable about an axis along the extending direction of the blade 90 by a tilt cylinder 103 shown in FIG. 1.

<Operation and Effects>

In the work equipment 10 of the motor grader 1 of the above-described configuration, when the pinion 51 is rotated by the driving of the slew motor 50, the inner ring 32 in which the inner gear teeth 32*b* are engaged with the pinion 51 is relatively rotated with respect to the outer ring 31 about the axis O. As a result, the circle 60 integrally fixed to the inner ring 32 is rotated about the axis O, and the blade 90 supported by the circle 60 via the support 80 is rotated about the axis O. Accordingly, by adjusting a rotation angle of the pinion 51 of the slew motor 50, a propulsion angle of the blade 90 can be set arbitrarily.

In the sliding portion between the outer ring 31 and the inner ring 32, it is necessary to supply grease L as a lubricant to smoothly rotate the outer ring 31 and the inner ring 32 relative to each other. The supply of the grease L is carried out via the lubricant supply unit 40. That is, when the grease L is pumped to the inlet port 41 of the lubricant supply unit 40 shown in FIG. 5, the grease L is introduced into the supply hole 31*b* of the outer ring 31 through the penetration pipe 42 and the connection portion 43. Then, the grease L flows inward in the radial direction in the supply hole 31*b* of the outer ring 31, so that the grease L is supplied to the rolling bodies 33 which are the sliding portion between the outer ring 31 and the inner ring 32, and the outer ring recessed groove 31*a* and the inner ring recessed groove 32*a*. As a result, lubrication at the sliding portion is ensured. Part of the grease L supplied to the sliding portion is discharged to upper and lower sides of the bearing 30 through a clearance between the outer ring 31 and the inner ring 32.

The grease L discharged to the lower side of the bearing 30 is introduced into the lower portion space S1. Since the inner peripheral-side wall portion 63 of the circle 60 is located outside the lower portion space S1 in the radial direction, the grease L is temporarily stored in the lower portion space S1 as the inner peripheral-side wall portion 63 being a dam. When grease L is filled in the lower portion space S1 by the grease L being sequentially discharged downward from the bearing 30, part of the grease L passes over the inner peripheral-side wall part 63. The grease L passing over the inner peripheral-side wall portion 63 reaches the lower-side gap G2 by passing through the inner peripheral-side gap G3 between the inner peripheral-side wall portion 63 and the outer peripheral-side rib 25, and then, the grease L is discharged to an outside (lower side) of the work equipment 10 through the discharge hole 61*b*.

On the other hand, the grease L discharged to the upper portion of the bearing 30 is introduced into an upper portion space R1, and is introduced on the upper-end surface of the inner ring 32. The grease L is sequentially discharged upward from the bearing 30, whereby the grease L in the upper-end surface of the inner ring 32 is pushed out inward in the radial direction, dropped to the bottom space R4 through the inner peripheral-side space R2 and the communication space R3, and then discharged to the lower side of the work equipment 10 through the bottom gap G4.

Here, depending on the working environment of the motor grader 1, dirt and water (hereinafter, referred to as dirt D) may fall down to the work equipment 10. In particular, a clearance C is formed between the drawbar plate 21 and the upper end of the outer peripheral-side wall portion 62 of the circle 60 to allow the relative rotation therebetween. When the dirt D entering an inside portion of the work equipment 10 through the clearance C reaches the bearing 30, the dirt D is caught between the outer ring 31 and the inner ring 32, thereby causing premature wear of the bearing 30.

On the other hand, in the present embodiment, the inner peripheral-side wall portion 63 protruding upward from the circle plate 61 is formed between the clearance C and the bearing 30. As a result, the dirt D which has flowed into the inside portion through the clearance C is introduced into a portion between the outer peripheral-side wall portion 62 and the inner peripheral-side wall portion 63. At this time, since the progress of the dirt D is prevented by the inner peripheral-side wall portion 63, it is possible to prevent the dirt D that has passed through the clearance C from directly reaching the bearing 30.

The grease L leaked downward from between the outer ring 31 and the inner ring 32 is stored in the lower portion space S1 inside the inner peripheral-side wall portion 63. By closing the path of the dirt D to the bearing 30 by the grease L accumulated in this manner, it is possible to suppress the progress of the dirt D. Therefore, even when the dirt D passes over the inner peripheral-side wall portion 63, it is possible to suppress the dirt D from reaching the bearing 30.

Thus, it is possible to prevent the dirt D from reaching the bearing 30 without scaling the clearance C by a member that has a sliding portion such as a lip seal and requires replacement because of wear. Therefore, the maintenance performance of the bearing 30 can be improved while securing the durability of the bearing 30.

For example, when a sealing member, such as a lip seal, is used instead of the clearance C, the lip seal itself comes into sliding contact with the drawbar 20 or the circle 60. Therefore, since the lip seal is worn, it is necessary to perform maintenance such as replacement of the lip seal periodically. Since the lip seal itself is not used in the present embodiment, it is not necessary to perform such a maintenance work. Therefore, durability of the work equipment 10 as a whole can be secured, and maintenance performance can be improved.

In the present embodiment, an outer peripheral-side rib 25 protruding downward from the drawbar plate 21 is disposed between the outer peripheral-side wall portion 62 and the inner peripheral-side wall portion 63 of the circle 60. The outer peripheral-side wall portion 62, the inner peripheral-side wall portion 63, and the outer peripheral-side rib 25 form the outer peripheral-side gap G1, the lower-side gap G2, and the inner peripheral-side gap G3 which are arranged so as to be sequentially communicated with each other from the clearance C. That is, in the present embodiment, a labyrinth-like structure including the outer peripheral-side gap G1, the lower-side gap G2, and the inner peripheral-side gap G3 is formed. In this manner, since the path from the clearance C to the bearing 30 is made to have a labyrinth-like structure, it is possible to further suppress the dirt D entering inside through the clearance C from reaching the bearing 30.

A size in the radial direction of the outer peripheral-side gap G1 and a size in the radial direction of the inner peripheral-side gap G3 have a value of, for example, approximately 0.1 to 1% of a diameter of the circle 60, in other words, a diameter of the outer peripheral-side wall portion 62. Accordingly, the entering of the dirt D can be appropriately suppressed while avoiding contact between the drawbar 20 and the circle 60 which are rotated relatively to each other.

Furthermore, in the present embodiment, the discharge hole 61*b* for discharging the grease L downward is formed between the outer peripheral-side wall portion 62 and the inner peripheral-side wall portion 63 of the circle plate 61. Thus, the dirt D introduced between the outer peripheral-side wall portion 62 and the inner peripheral-side wall portion 63 can be discharged downward directly or together with the grease L through the discharge hole 61*b*.

Since the discharge hole 61*b* is located immediately below the lower end of the outer peripheral-side rib 25 of the drawbar 20, that is, the discharge hole 61*b* is opened in the lower-side gap G2 having a large flow resistance, the dirt D passing through the lower-side gap G2 can be smoothly guided to the discharge hole 61*b*.

On the other hand, since the bottom gap G4 and the communication space R3 are spaced away in the radial direction, the dirt D passing through the bottom gap G4 and entering inside does not directly rise to the vicinity of the inner ring 32 through the communication space R3 and the inner peripheral-side space R2. That is, the dirt D that has passed through bottom gap G4 stays on the bottom cover 70 in the bottom space R4 between the bottom gap G4 and communication space R3. Thus, the entering of the dirt D through the discharge path of the grease L leaked upward from the bearing 30 can be suppressed. Therefore, the durability of the bearing 30 can be secured, and the maintenance frequency can be reduced.

Other Embodiments

Although the present embodiment of the present invention has been described above, the present invention is not limited thereto, and may be appropriately changed without departing from the technical idea of the present invention.

In the embodiment, grease L is used as lubricant to be introduced into the bearing 30 through the lubricant supply unit 40, but other lubricant such as lubricating oil having a viscosity lower than that of the grease L may be used.

In the embodiment, an example in which both the outer peripheral-side rib 25 and the inner peripheral-side rib 26 are provided on the drawbar 20 has been described, but any one of them may not be provided. The discharge hole 61*b* of the circle plate 61 is not limited to an example formed between the outer peripheral-side wall portion 62 and the inner peripheral-side wall portion 63 and may be formed in other portion such as an inside in the radial direction of the inner peripheral-side wall portion 63. Further, the discharge hole 61*b* may not be provided. Further, the bottom cover 70 may not be provided.

INDUSTRIAL APPLICABILITY

According to the work equipment for the motor grader of the present invention, durability of the work equipment can be secured, and maintenance performance can be improved.

EXPLANATION OF REFERENCE SIGN

1: Motor Grader,
2: Traveling Wheels (Front Wheels),
3: Traveling Wheels (Rear Wheels),
4: Vehicle Body Frame,
5: Rear Frame,
6: Front Frame,
6*a*: Counter Weight,
7: Exterior Cover,
8: Cab,
10: Work Equipment,
20: Drawbar,
21: Drawbar Plate,
21*a*: Plate Front Portion,
21*b*: Plate Rear Portion,
21*c*: Motor Through Hole,
22: Lateral Rib,
23: Vertical Rib,
24: Connecting Portion,
25: Outer Peripheral-side Rib,
26: Inner Peripheral-side Rib,
30: Bearing,
31: Outer Ring,
31*a*: Outer Ring Recessed Groove,
31*b*: Supply Hole,
32: Inner Ring,
32*a*: Inner Ring Recessed Groove,
32*b*: Inner Gear Teeth,
33: Rolling Body,
40: Lubricant Supply Unit,
41: Inlet Port,
42: Penetration Pipe,
43: Connection Portion,
50: Slew Motor,
51: Pinion,
60: Circle,
61: Circle Plate,
61*a*: Inner Peripheral Edge Portion,
61*b*: Discharge Hole,
62: Outer Peripheral-side Wall Portion,
63: Inner Peripheral-side Wall Portion,
64: Lower-side Wall Portion,
70: Bottom Cover,
71: Outer Peripheral Edge Portion,
80: Support,
90: Blade,
101: Lift Cylinder,
102: Drawbar Shift Cylinder,
103: Tilt Cylinder,
A1: Front Portion Region,
A2: Rear Portion Region,
A3: Side Portion Region,
C: Clearance,
G1: Outer Peripheral-side Gap,
G2: Lower-side Gap,
G3: Inner Peripheral-side Gap,
G4: Bottom Gap,
R1: Upper Portion Space,
R2: Inner Peripheral-side Space,
R3: Communication Space,
R4: Bottom Space,
S1: Lower Portion Space,
S2: Outer Peripheral-side Space,
O: Axis,
L: Grease,
D: Dirt

The invention claimed is:

1. A work equipment for a motor grader comprising:

a drawbar having a drawbar plate extending along a horizontal surface;

a bearing having an outer ring which has an annular shape when seen from a plan view and is fixed to a lower surface of the draw bar plate, and an inner ring which has an annular shape when seen from a plan view and is disposed inside the outer ring and which is connected to the outer ring so as to be rotatable in a peripheral direction with respect to the outer ring;

a lubricant supply unit configured to supply a lubricant between the outer ring and the inner ring in the bearing;

a circle having a circle plate that is fixed to a lower end of the inner ring over the peripheral direction and protrudes outward in a radial direction of the outer ring, an outer peripheral-side wall portion that is connected to an outer peripheral side of the circle plate and has a cylindrical shape surrounding the bearing from an outer peripheral side and that forms a clearance between the outer peripheral-side wall portion and the lower surface of the drawbar plate, and an inner circumferential-side wall portion that protrudes from the upper surface of the circle plate between the bearing and the outer peripheral-side wall portion, extends in the peripheral direction, and faces the outer ring and the outer peripheral-side wall portion in the radial direction; and a blade supported by the circle;

wherein the circle plate has a discharge hole penetrating vertically the circle plate between the outer peripheral-side wall portion and the inner peripheral-side wall portion.

2. The work equipment for the motor grader according to claim 1, wherein the drawbar further comprises:

an outer peripheral-side rib that protrudes from the lower surface of the drawbar plate between the peripheral-side wall portion and the inner peripheral-side wall portion, extends in the peripheral direction, and faces the outer peripheral-side wall portion and the inner peripheral-side wall portion from the radial direction.

3. The work equipment for the motor grader according to claim 1, wherein the drawbar further comprises:

an inner peripheral-side rib that protrudes from a lower surface of the drawbar plate to below the circle plate in an inside in the radial direction of the inner ring and the circle plate and extends in the peripheral direction, and wherein the circle further comprises:

a lower-side wall portion that protrudes downward from the lower surface of the circle plate in an outside in the radial direction of the inner peripheral edge portion of the circle plate and extends in the peripheral direction, and a bottom cover that is fixed to the lower end of the inner peripheral-side rib over the circumferential direction, and that is protruded outward in the radial direction and forms a bottom gap between the lower-side wall portion and the bottom cover.

4. The work equipment for the motor grader according to claim 2, wherein the circle plate has a discharge hole penetrating vertically the circle plate between the outer peripheral-side wall portion and the inner peripheral-side wall portion.

5. The work equipment for the motor grader according to claim 2, wherein the drawbar further comprises:

an inner peripheral-side rib that protrudes from a lower surface of the drawbar plate to below the circle plate in an inside in the radial direction of the inner ring and the circle plate and extends in the peripheral direction, and wherein the circle further comprises:

a lower-side wall portion that protrudes downward from the lower surface of the circle plate in an outside in the radial direction of the inner peripheral edge portion of the circle plate and extends in the peripheral direction, and a bottom cover that is fixed to the lower end of the inner peripheral-side rib over the circumferential direction, and that is protruded outward in the radial direction and forms a bottom gap between the lower-side wall portion and the bottom cover.

6. The work equipment for the motor grader according to claim 4, wherein the drawbar further comprises:

an inner peripheral-side rib that protrudes from a lower surface of the drawbar plate to below the circle plate in an inside in the radial direction of the inner ring and the circle plate and extends in the peripheral direction, and wherein the circle further comprises:

a lower-side wall portion that protrudes downward from the lower surface of the circle plate in an outside in the radial direction of the inner peripheral edge portion of the circle plate and extends in the peripheral direction, and a bottom cover that is fixed to the lower end of the inner peripheral-side rib over the circumferential direction, and that is protruded outward in the radial direction and forms a bottom gap between the lower-side wall portion and the bottom cover.

* * * * *